US006099396A

United States Patent [19]

Krone-Schmidt

[11] Patent Number: 6,099,396

[45] Date of Patent: Aug. 8, 2000

[54] CARBON DIOXIDE JET SPRAY PALLET CLEANING SYSTEM

[75] Inventor: Wilfried Krone-Schmidt, Fullerton, Calif.

[73] Assignee: Eco-Snow Systems, Inc., Livermore, Calif.

[21] Appl. No.: 08/818,522

[22] Filed: Mar. 14, 1997

[51] Int. Cl.[7] ..... B24C 3/12

[52] U.S. Cl. ..... 451/80; 451/39

[58] Field of Search ..... 451/39, 78, 80, 451/81, 53, 75, 87, 88

[56] References Cited

U.S. PATENT DOCUMENTS

| | | | |
|---|---|---|---|
| 5,025,597 | 6/1991 | Tada et al. | 451/39 |
| 5,367,838 | 11/1994 | Visaisouk et al. | 451/75 |
| 5,419,733 | 5/1995 | Johnson et al. | 451/39 |
| 5,766,368 | 6/1998 | Bowers | 451/39 |

FOREIGN PATENT DOCUMENTS

| | | | |
|---|---|---|---|
| 8223563 | 12/1983 | Japan | 451/39 |

*Primary Examiner*—Robert A. Rose
*Attorney, Agent, or Firm*—R. Craig Armstrong

[57] ABSTRACT

Apparatus for cleaning a moving pallet and components carried thereby. The apparatus includes a processing system that employs the moving pallet. An environmental cleaning station is provided through which the pallet moves. The cleaning station includes a recirculating blower system and a high efficiency particulate air filter. A ducting system or warm air system may be provided for supplying purified air, inert gas, or warm air to eliminate condensation. A carbon dioxide jet spray cleaning system is provided that has jet spray nozzles disposed within the cleaning station that are coupled by way of a manifold to a liquid carbon dioxide tank that supplies liquid carbon dioxide to the jet spray nozzles. The jet spray nozzles generate a carbon dioxide snow spray that impinges on the moving pallet to clean it along with the components it carries.

4 Claims, 2 Drawing Sheets

CARBON DIOXIDE JET SPRAY PALLET CLEANING SYSTEM

BACKGROUND

The present invention relates generally to cleaning systems, and more particularly, to apparatus that uses a liquid carbon dioxide jet spray cleaning system to clean moving pallets that hold components and/or subassemblies during manufacture.

Pallets, such as those used in holding and transporting precision electronic components and subassemblies during assembly and fabrication processes, and the like, carry contaminants along with them in the form of particulate matter and dust. For example, pallets are used during manufacturing of antilock brake systems. The pallets hold individual components while they are transported by conveyor belt to different processing stations. At each different processing station, different tasks are performed on the respective components, such as drilling precision holes in and through the components, for example. The contaminant particulate matter, such as metal debris produced by the drilling operations, can find its way onto and into the components and assemblies during these processing operations. This can potentially result in damaged components or systems, and can lead to low manufacturing yields.

Heretofore, no manufacturer has attempted to precision clean the pallets and components carried thereby during processing. Typically, the pallets are not cleaned at all during processing, and only cleaned prior to or after use. Conventionally, compressed gas coupled to air knives or vacuum devices have been used to clean the pallets after use, with poor results. Furthermore, no conventional cleaning procedure provides acceptable cleaning performance that may be used during processing of the pallets.

Consequently, it would be advantageous to have an apparatus for cleaning a moving pallet and components carried thereby during its use in a conveyorized processing or manufacturing system. Accordingly, it is an objective of the present invention to provide for such an apparatus.

SUMMARY OF THE INVENTION

To meet the above and other objectives, the present invention provides for apparatus that may be used to clean a moving pallet and components carried thereby during conveyorized manufacturing processes. The apparatus comprises a carbon dioxide jet spray cleaning system disposed within an environmental cleaning station of a processing system that employs a moving pallet.

The processing system is a conveyorized system wherein a conveyor belt or web transports the pallet from processing station to processing station. The pallet holds components, such as electronic and mechanical components that are processed at each of the processing stations. The cleaning station provided by the present invention includes a recirculating blower system, and a high efficiency particulate air (HEPA) filter. An optional ducting system for recirculating purified air or inert gas may be employed, or a system that supplies warm dry air stream adjacent the pallet during processing to avoid condensation, such as one or more air knifes, or an in-line heater system, for example. The cleaning station is disposed above the web, and contains individual jet spray nozzles and/or a set of jet spray nozzles. The plurality of sets of jet spray nozzles are coupled by way of a manifold to a liquid carbon dioxide tank that supplies liquid carbon dioxide to the jet spray nozzles.

The pallet is caused to stop below the cleaning station. The plurality of sets of jet spray nozzles are disposed above the pallet and spray carbon dioxide snow onto the moving pallet. The plurality of sets of jet gas spray nozzles spray carbon dioxide snow onto the moving pallet to clean it. The spraying environment is dry to eliminate condensation on the pallet or components carried thereby.

During operation, liquid carbon dioxide is supplied to the sets of jet spray nozzles. Jet sprays of carbon dioxide snow produced by the sets of jet spray nozzles impinge upon the surface of the pallet. The action of the jet sprays cleans contaminating particles from the surface of the pallet. The removed particles are swept away by the flow of air or inert gas and are filtered by the HEPA filter.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
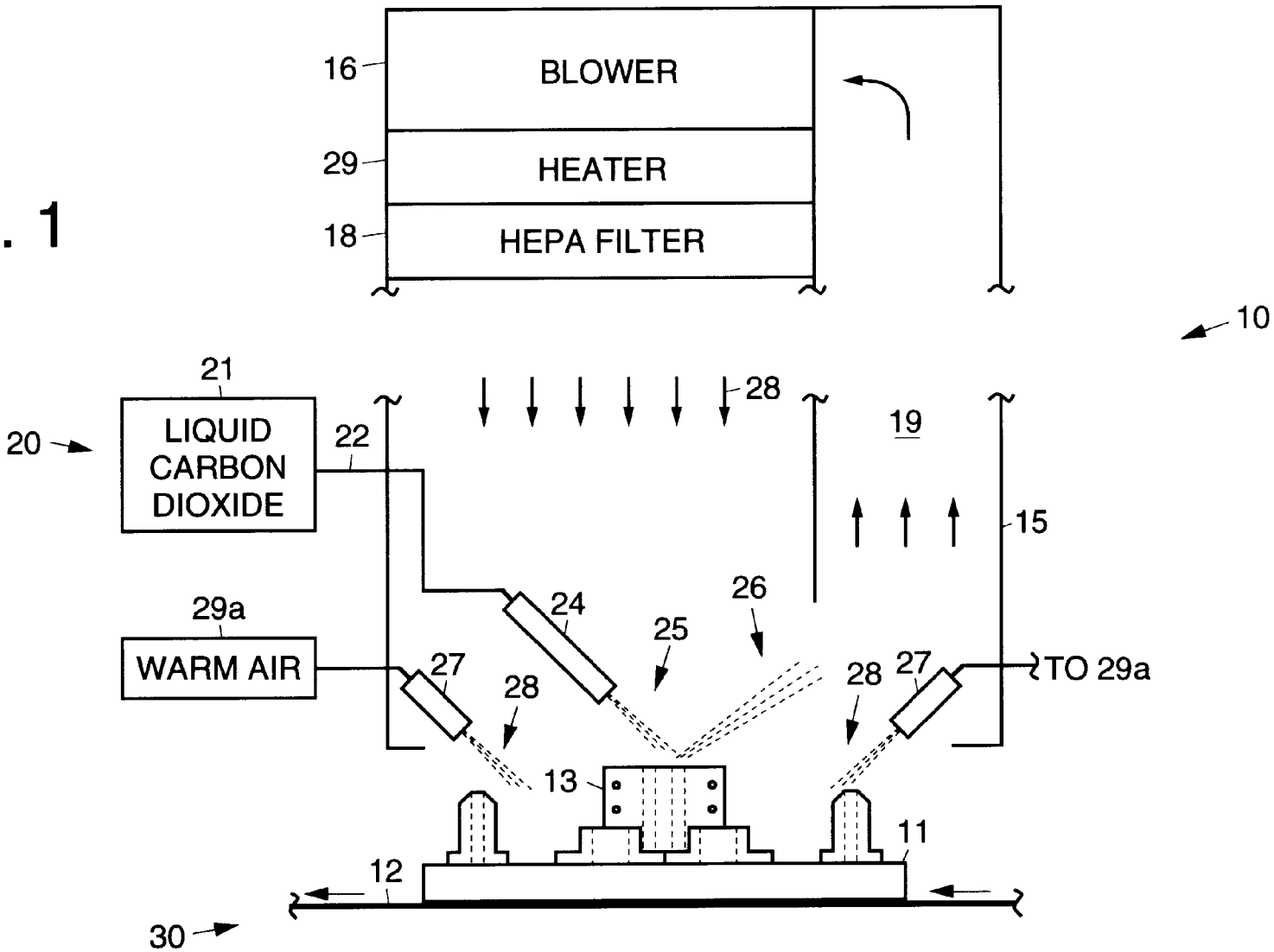
FIG. 1 illustrates a side view of apparatus in accordance with the principles of the present invention for cleaning a moving web.
Figure 2:
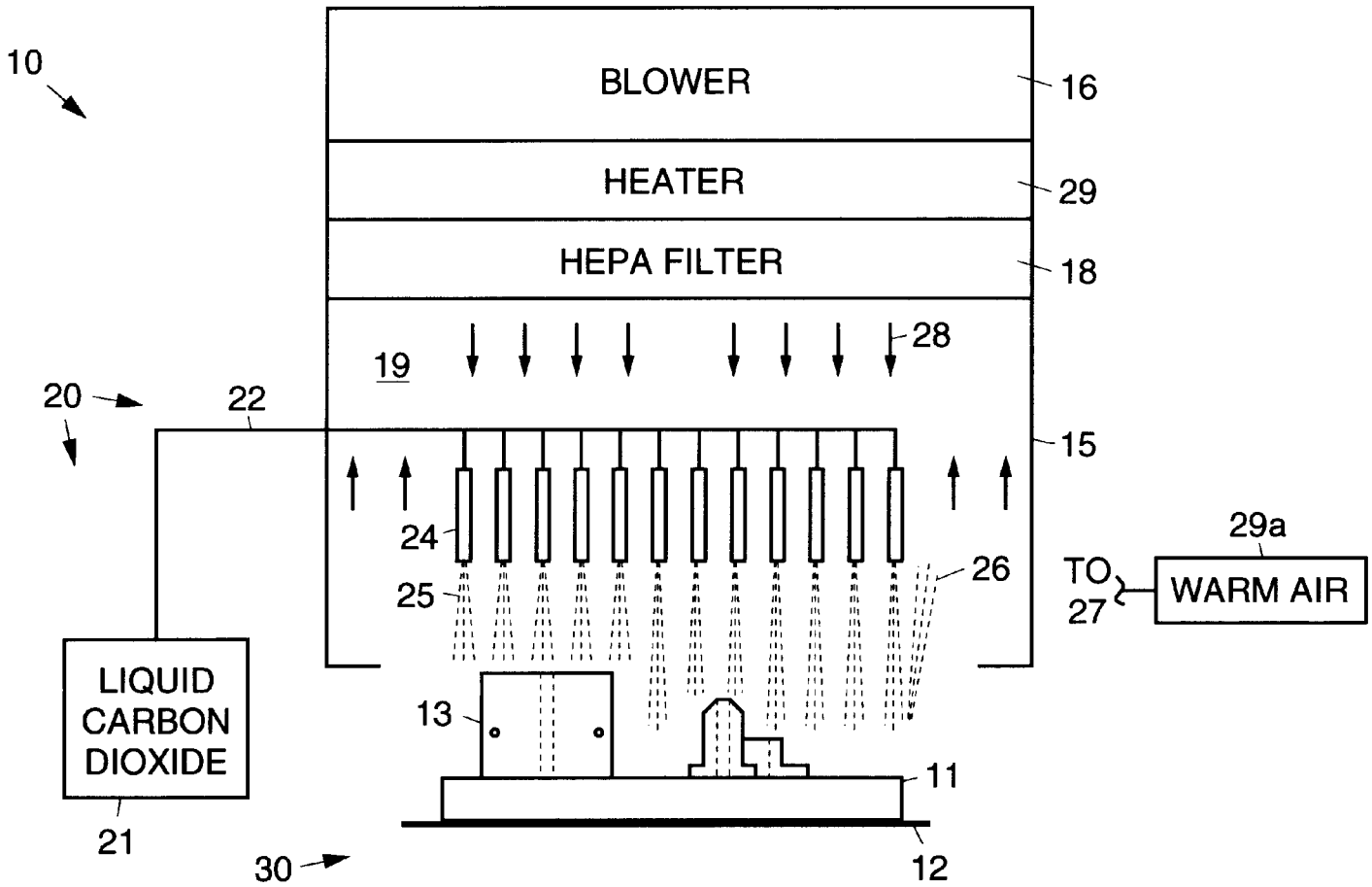
FIG. 2 illustrates an end view of the apparatus of FIG. 1.

Referring to the drawing figures, FIG. 1 is a side view illustrating apparatus 10 in accordance with the principles of the present invention for cleaning a moving pallet 11 that is used in a conveyorized manufacturing process. FIG. 2 illustrates an end view of the apparatus 10 of FIG. 1. The apparatus 10 comprises a carbon dioxide jet spray cleaning system 20 having one or more jet spray nozzles 24 disposed within an environmental cleaning station 15 of a processing system 30 that employs the moving pallet 11.

The processing system 30 is a conveyorized system wherein the moving pallet 11 is transported by a moving conveyor belt 12, for example, that transports components 13 from one processing station to another. The pallet 11 is caused to stop below the cleaning station 15 that implements the present invention.

The cleaning station 15 provided by the present invention includes a recirculating blower system 16 and a high efficiency particulate air (HEPA) filter 18. A ducting system 19 is provided for recirculating purified air 28 or inert gas 28 through the cleaning system 20. Alternatively, a ducting system 19 supplies a stream of warm dry air 28 derived from a heater 29 during processing to avoid condensation. The warm air 28 may also be provided by an in-line heater 29, or by means of one or more air knives 27 that blow warm air 28 derived from a warm air source 29*a* or heater 29*a*, for example. The cleaning station 15 is disposed above the moving pallet 11, and contains individual jet spray nozzles 24 or a set of jet spray nozzles 24. The jet spray nozzles 24 are coupled by way of a liquid carbon dioxide manifold 22 to a liquid carbon dioxide tank 21 that supplies liquid carbon dioxide to the jet spray nozzles 24.

The jet spray nozzles 24 are disposed above the pallet 11 and generate a carbon dioxide snow spray 25 that impinge on the moving pallet 11 as it moves past the nozzles 24. As the pallet 11 moves past the nozzles 24, the jet gas spray nozzles 24 spray the carbon dioxide snow spray 25 onto the moving pallet 11 to clean it along with the components 13 that it carries. Because the cleaning station 15 provides a dry environment, this also eliminate condensation on the pallet 11 and components 13.

During operation, liquid carbon dioxide is supplied to the sets of jet spray nozzles 24 by way of the liquid carbon dioxide manifold 22. Jet sprays 25 of carbon dioxide snow produced by the jet spray nozzles 24 impinge upon the surface of the moving pallet 11. The action of the jet sprays 25 cleans contaminating particles 26 from the surface of the moving pallet 11 as well as the components 13 carried thereby. The removed contaminating particles 26 are swept away by the flow of air 28 or inert gas 28 and are filtered by the HEPA filter 18.

The cleaning station 15 forms a controlled environmental enclosure that is similar to a process enclosure disclosed in U.S. Pat. No. 5,316,560 entitled "Environment Control Apparatus", which is assigned to the assignee of the present invention, the contents of which are incorporated herein by reference. The cleaning station 15 is constructed and operates in a manner similar to the controlled environmental enclosure disclosed in this patent.

The jet spray nozzles 24 produce jet sprays 25 of gaseous and solid carbon dioxide material (snow) that is used to clean the moving pallet 11 and components 13. The carbon dioxide snow spray 25 comprises solid carbon dioxide particles and gas and is sprayed from the jet spray nozzles 24 onto the pallet 11 and components 13 to clean them. Momentum transfer between the solid carbon dioxide particles in the carbon dioxide snow spray 25 and contaminant particles 26 on the sprayed surface of the moving pallet 11 removes the contaminant particles 26 from the surface. Individual jet spray nozzles 24 may be used to separately clean specific openings in the components 13 or specific surfaces or areas of the components 13, as required.

Excess gas from the jet sprays 25 and contaminant particles 26 dislodged from the moving pallet 11 and components 13 are collected and are removed by the HEPA filter 18. The high capacity blower system 16 thus supplies a flow of clean air 28 or gas 28 to the cleaning station 15.

Thus, apparatus for cleaning a moving pallet and components that it carries during its use in a conveyorized processing system has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. Apparatus for cleaning a moving pallet and components carried thereon located on a conveyor, without removal of said pallet from said conveyor, characterized by:

a processing system comprising a moving conveyor having a pallet;

a cleaning station forming a controlled environment enclosure disposed adjacent to the moving pallet and past which the pallet moves, and which comprises a recirculating blower system, and a high efficiency particulate air filter; and a carbon dioxide jet spray cleaning system comprising jet spray nozzles disposed within the cleaning station that are coupled by way of a manifold to a liquid carbon dioxide tank that supplies liquid carbon dioxide to the jet spray nozzles, and wherein the jet spray nozzles generate a carbon dioxide snow spray that impinges on the moving pallet and components thereon to clean said pallet and components thereon.

2. The apparatus of claim 1 wherein the blower system comprises:

a ducting system positioned to draw air or inert gas from an area near where said cleaning occurs and to recirculate said air or inert gas within said controlled environment enclosure.

3. The apparatus of claim 1 wherein the environmental cleaning station further comprises:

a system that supplies a stream of warm dry air derived from a heater during processing to eliminate condensation.

4. The apparatus of claim 1 wherein the environmental cleaning station further comprises:

an air knife disposed adjacent to the pallet that blows warm air derived from a warm air source onto the pallet during processing to eliminate condensation.

* * * * *